United States Patent [19]

Koyama

[11] Patent Number: 4,632,286

[45] Date of Patent: Dec. 30, 1986

[54] CLOTHES HANGER

[76] Inventor: Hisashi Koyama, 22/401, Syakusonji-cho, 25-banchi, Hirakata-shi, Osaka-fu 573, Japan

[21] Appl. No.: 807,208

[22] PCT Filed: Jul. 1, 1983

[86] PCT No.: PCT/JP83/00212

§ 371 Date: Mar. 1, 1984

§ 102(e) Date: Mar. 1, 1984

[87] PCT Pub. No.: WO84/00100

PCT Pub. Date: Jan. 19, 1984

Related U.S. Application Data

[63] Continuation of Ser. No. 589,072, Mar. 1, 1984, abandoned.

[30] Foreign Application Priority Data

Jul. 1, 1982 [JP] Japan ..... 57-115163

[51] Int. Cl.[4] ..... A47G 25/16; A47G 25/30

[52] U.S. Cl. ..... 223/88; 223/95; 211/113; 211/119; D6/317; D6/319

[58] Field of Search ..... D6/315, 317–319, D6/327; 223/87, 88, 91, 92, 95, 96, 97; 211/113, 119

[56] References Cited

U.S. PATENT DOCUMENTS

| | | | |
|---|---|---|---|
| D. 148,407 | 1/1948 | Cleary | 223/88 X |
| 1,980,939 | 11/1934 | Goerner | 223/88 |
| 3,013,706 | 12/1961 | Morton | 223/96 |
| 3,348,745 | 10/1967 | Basile et al. | 223/88 |

FOREIGN PATENT DOCUMENTS

| | | | |
|---|---|---|---|
| 128087 | 6/1948 | Australia | 223/88 |
| 162734 | 5/1955 | Australia | 223/95 |
| 251695 | 1/1963 | Australia | 223/95 |
| WO84/00100 | 1/1984 | Japan | 223/95 |

*Primary Examiner*—Robert R. Mackey

*Attorney, Agent, or Firm*—Murray and Whisenhunt

[57] ABSTRACT

A garment hanger has a base with a hook and a trousers mount. A connector connects the base and the trousers mount in such a way that one end of the mount is open and a space for hanging and removing trousers is formed between the base and the mount. The ends of the mount are provided with elements which engage and hold the trousers only when the hanger is tilted so as to prevent the trousers from sliding off the mount.

21 Claims, 39 Drawing Figures

CLOTHES HANGER

CROSS-REFERENCES TO RELATED APPLICATIONS

This application is a continuation of application Ser. No. 589,072 filed Mar. 1, 1984, now abandoned.

BACKGROUND OF THE INVENTION

1. Field of the Invention

This invention deals with garment hangers which have a base and a trousers mounting part, as well as a connecting part linking the two, an end of the trousers mounting part being open in order to make easier mounting and dismounting of the trousers possible, and further to avoid having the trousers fall off, especially in case the hanger is inclined.

2. Description of the Prior Art:

Although a type of clothes hanger composed of a trousers mounting portion and a coat mounting portion, having an end of the trousers mounting portion open-ended in order to make mounting and dismounting of the trousers easier has been known, this type of hanger has the defect that the mounted trousers can easily come off in case the open-ended part is inclined downwardly.

Also, in the case of the type of garment hanger which has the trousers mounting portion made of iron or a metallic material, the defect of the mounted trousers sliding or coming off, if inclined even slightly, is found. This defect is exacerbated by the staining of the trousers when they fall on the floor. Even in the case of where the end part of the open-end was bent up to prevent the trousers from falling off, the preventive effect was observed to be poor, and produced difficulties in mounting and dismounting the trousers, together with the same being caught by the protrusion at the end while in the act of mounting or dismounting the trousers.

This type of hanger was originally produced in order to ease the mounting and dismounting actions, however, in fact, it failed to be effective in preventing the trousers from sliding and falling off. The trousers mount part of conventional garment hangers has been equipped with antiskid materials of rubber or sponge for the prevention of the sliding of the trousers, however, this also has a fault in that it is not possible to mount and dismount the trousers smoothly due to the contact friction between the surface of the trousers and the anti-skid material, while the trousers were being mounted and dismounted. Especially, in the case of a triangle-shaped hanger, the anti-skid material hampered the actions of mounting and dismounting as the trousers were to go through the loop before the mounting or dismounting action was completed. Further, in the cases of a triangle-shaped hanger with an open end trousers mount or with the trousers mount of anti-skid material, such as rubber or sponge, without a coat mount part provided, these too have failed to have sufficient preventive effect to keep the trousers from falling off when inclined toward the open end. Also, these types of hangers have the defect of causing multiple wrinkles or creases at the folded part of the trousers as the trousers are pressed against the upper surface of the trousers mount part by the trousers' own weight.

In the case of the type of hanger which pinches the trousers for hanging support, the action for hanging the trousers was troublesome. The present invention relates to clothes hangers without these defects.

SUMMARY OF THE INVENTION

The present invention overcomes the aforementioned problems by providing a garment hanger comprising a hook for engaging a rail or other support; a trouser mount for supporting a pair of trousers, the trouser mount including a trouser mounting member adapted to support a pair of trousers folded thereover and having a spaced apart pair of ends. The ends are spaced apart a distance which is less than the width of a pair of trousers folded thereover. The hook and the trouser mount are connected by a connector having three portions, a first portion connected to and extending downwardly from the trouser mounting member, a third portion connected to and extending downwardly from the hook and the second portion connecting the first and third portions below the trouser mounting member and proximate one end of the trouser mounting member. The hook and the connector cooperate to support the trouser mounting member below the hook with the trouser mounting member disposed horizontally. The first and second portions of the connector define a recess below the horizontally disposed trouser mounting member, the recess being centered on the one end of the trouser mounting member. The garment hanger also includes a holding member which engages and holds the trousers against slippage with respect to the trouser mounting member, when the other end of the trouser mounting member is lowered with respect to the one end. The holding member is located proximate the one end of the trouser mounting member so as to engage the trousers only when the other end of the mounting member is lowered with respect to the one end.

BRIEF DESCRIPTION OF THE DRAWING FIGURES

DETAILED DESCRIPTION OF THE INVENTION

Figure 1:
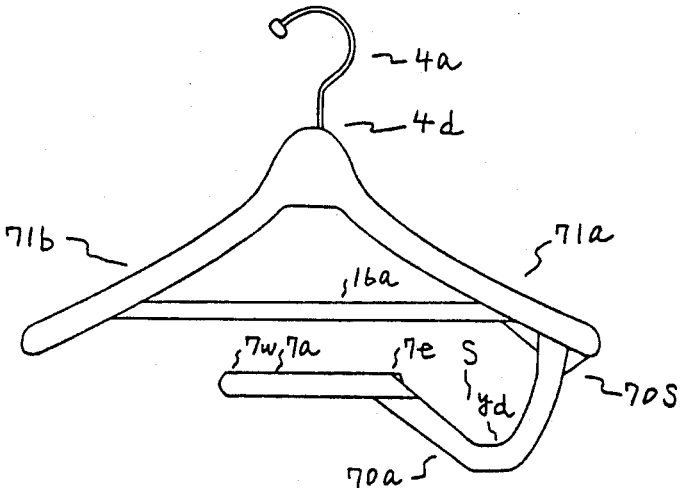
FIG. 1 is a side view of a garment hanger according to the present invention.
Figure 2:
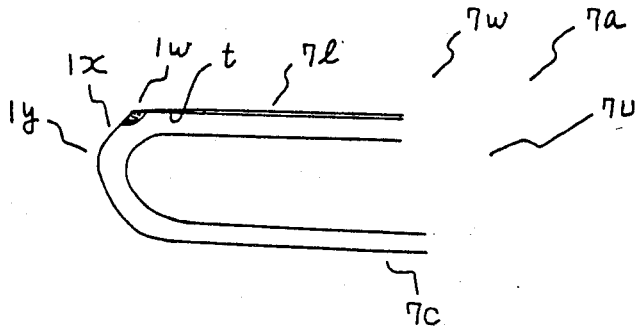
FIG. 2 is a side view of the open end of the trouser mount portion.
Figure 3:
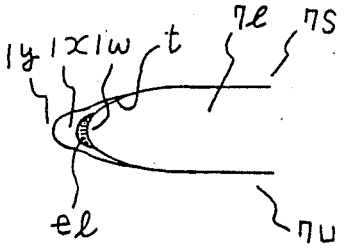
FIG. 3 is a plan view of the open end of the trouser mount portion of FIG. 2.
Figure 4:
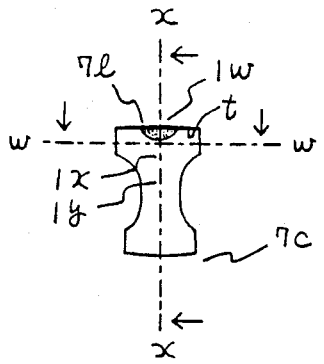
FIG. 4 is a rear view of the open end of the trouser mount portion of FIG. 2

The following explanation of the clothes hanger according to the present invention is given in connection with and with reference to the drawing figures.

As indicated in FIGS. 1 to 16, in clothes hangers made of plastics, etc., the trousers mount part *7a* has an open end at *7w* and at the other end *7e*, is connected to the base of coat mount *71a*, *71b* through connecting part *70a* which forms a recess S lower than the upper surface 71.

At the trousers mount part *7a*, the open end *7w* has such a shape that the trousers are not caught on it during the actions of mounting and dismounting, nor hampered in such actions, and the shape ensures smooth mounting and dismounting, yet which shape has an appropriate form to enable the trousers to be kept in place when inclined toward the side having recess S.

As indicated in FIGS. 2 to 6, at the end *7w*, an edge t of half elliptical shape is formed at the open-end side of the upper surface 71 from side *7u* to the other side *7s*.

The half elliptical shape of the edge t desirably forms an acute or sharp shape in outline on the perpendicular cross-section. On the outer surface of the open end, a protrusion *1y* of an arc shape is formed, which is composed of a smooth arc surface protruding more and more as it comes downward obliquely from edge t. At the protrusion 16 of arc surface shape, the horizontal width is appropriately narrow and shaped in a thin and smooth arc to ensure smooth mounting and dismounting of the trousers, as well as to avoid the trousers being caught on or damaged during mounting or dismounting, for example, in a curved or bent rib shape from the upper surface 71 downward to the bottom surface *7c*. The arc surface *1x* is formed on an almost straight line extending from the end of the upper surface 71 to the protrusion *1y* of the arc shape.

Figure 5:
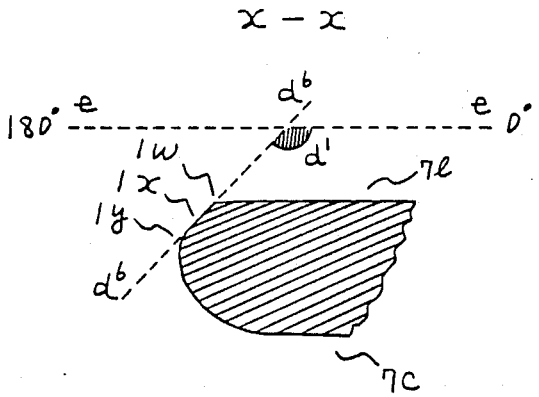
FIG. 5 is a cross-section of FIG. 4 taken along line x—x.
Figure 6:
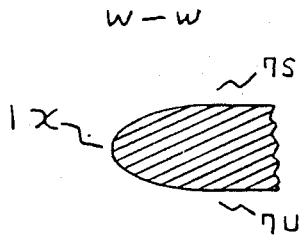
FIG. 6 is a cross-section of FIG. 4 taken along line w'w.
Figure 7:
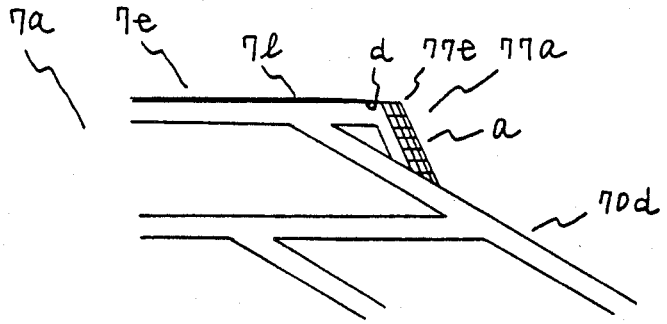
FIG. 7 is a side view of the recess side end of the trouser mount portion.
Figure 8:
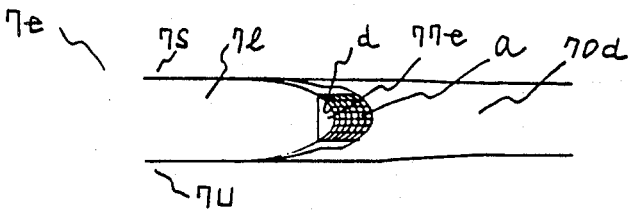
FIG. 8 is a plan view of the recess side end of FIG. 7.
Figure 9:
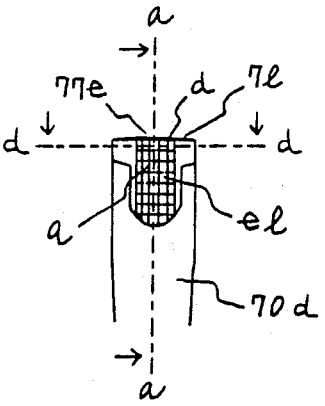
FIG. 9 is a front view of the recess side end of FIG. 7.

The holding part for trousers *1w* is formed at a boundary part between the edge t of the upper surface 71 and the arc surface *1x*. The holding part *1w* holds the trousers when the hanger is inclined toward the side of recess S. As shown in FIGS. 5 and 6, the holding part for trousers *1w* is preferably formed to make a sharp shape by the upper surface 71 and the arc surface *1x*, in the outline of the perpendicular cross-sectional position including the longitudinal axial center line of the mount part *7a*, and horizontally forms an arc shape.

The outer surface of the arc surface *1x*, as indicated in FIG. No. 5, is desirably almost straight vertically, the angle d1 formed with the upper surface 71 is within an appropriate range of angles, and horizontally forms an arc surface. The outer surface from the arc surface *1x* to the sides *7s* and *7u* is smoothly formed and also the outer surface from the protrusion *1y* of the arc shape to the bottom surface *7c* is shaped smoothly for easy mounting and dismounting of the trousers.

To increase the skid-preventive effects for the trousers upon inclination of the hanger when trousers are being mounted, shallow micro-groovings el are provided at a position near to the holding part *1w* in the arc surface *1x*. It is desirable that the micro-groovings el be made to such a degree as to not hamper the mounting of trousers. As shown in FIG. 5, the angle d1 formed by the arc surface *1x* or the outer surface downward of the holding part *1w* at the perpendicular cross section x—x along the axial center line, between the average line d6—d6 and a line e—e parallel to the axial center line is desirably 76°–147°, and more desirably 116°–140°. Also, the shape of the end *7e*, adjacent recess S, of the mount part *7a* has an appropriate form to keep the mounted trousers from falling off when the hanger is inclined toward the open end, and furthermore to provide easy mounting and dismounting of the trousers.

Figure 10:
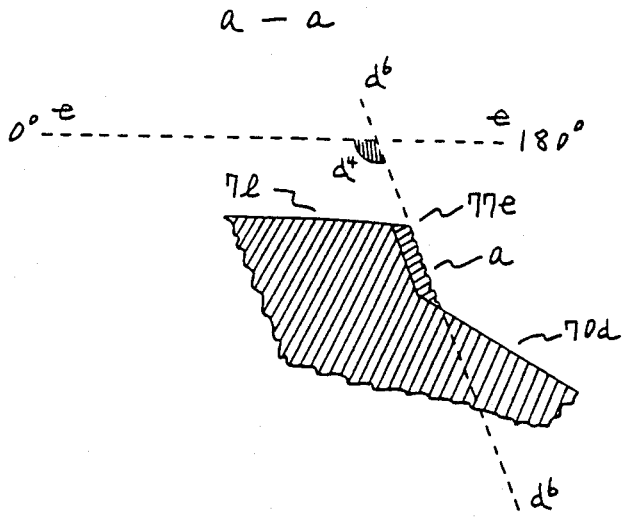
FIG. 10 is a cross-section of FIG. 9, taken along line a-a.
Figure 11:
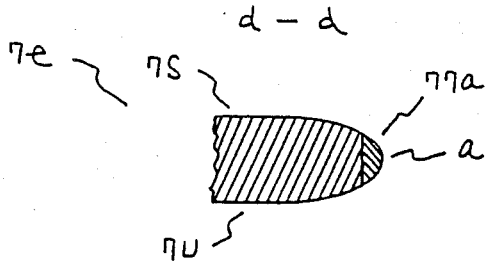
FIG. 11 is a cross-section of FIG. 9, taken along line d-d.

As indicated in FIGS. 7 to 11, at the end *7e*, an edge d of half elliptical shape is formed at the recess side of the upper surface 71 from the side *7u* to the other side *7s*. The half elliptical shape of the edge d desirably forms an acute or sharp shape in outline on the perpendicular cross section. The straight arc surface a is formed from the end of the upper surface 71 obliquely downward to the upper surface *70d* of the connecting part *70a*. The holding part *77e* for trousers is formed at a boundary between the edge d of the upper surface 71 and the straight arc surface a. The holding part *77e* for trousers holds the trousers when the hanger is inclined toward the open end side. As shown in FIGS. 10 and 11, the holding part *77e* for trousers is formed desirably to make a sharp shape by the upper surface 71 and the straight arc surface a in the outline of the perpendicular cross section including the axial center line of the mount part *7a*, and horizontally forms an arc shape. As shown in FIG. 10, the outer surface of the straight arc surface a is formed desirably straight vertically and the angle d4 formed with the upper surface 71 provides an angle within an appropriate range of angles, and further forms an arc shape horizontally. The holding part *77e* for trousers or the straight arc surface a are desirably made of a rubber material, where a rubber body *77a* is attached. The micro-groovings el are desirably provided on a portion near to the holding part 77*e* for trousers or on the straight arc surface a, where dents of the micro-groovings are made, for instance, horizontally, vertically or obliquely. As shown in FIG. 10, the angle d4 formed by the straight area of the arc surface a or the outer downward surface of the holding part 77*e* for trousers at the perpendicular cross section a—a along the axial center line, between the average line d6—d6 and a line e—e parallel to the axial center line is desirably 76°-147° and more desirably 104°-127°.

The edges d and t formed on the upper surface ends 7*e* and 7*w* of the mount part 7*a* and the holding effects of the holding parts for trousers 1*w* and 77*e*, in combination with the angles d1 and d4 being formed appropriately, produces a holding effect on the trousers which prevents them from sliding or falling off during inclination of the hanger in the actions of mounting and dismounting the trousers. The half elliptical shape of the edges d and t contacts the surface of trousers with a smooth surface, and further, the straightness of the straight arc surface a excludes the hazard of the trousers being caught or damaged while being mounted or dismounted, thereby ensuring smooth actions.

The proper narrow width of the arc-shaped protrusion 1*y* in the horizontal direction at right angles to the axial center line and the smoothness of the part provide for a msooth insertion between the surfaces of the trousers and this leads to an extremely easy action in mounting and dismounting trousers. Since the rubber body 77*a* is fixed on the portion nearest to the mounted trousers' fringe to the side of the connecting part 70*s*, without being positioned on the upper surface or sides of the mount part 7*a*, the trousers' surface experiences a minimum contact with the rubber body at mounting or dismounting, which ensures extremely smooth mounting and dismounting excluding difficulties in the action due to the contact friction effects between the trousers' surface and the anti-skid material.

The angles d1 or d4, at the ends 7*w* or 7*e*, respectively, produce a lowered holding effect if the angle is increased to be more than the previously described range; and have an enhanced holding effect if the angle is decreased to be less than the previously defined range, however, in this case it would pose a defect because the trousers would tend to be caught thereon.

Further, it is of course possible that a rubber body is attached at the holding part 1*w* to the end side 7*w*, or rough-faced vinyl chloride or rubber or EVA substance is attached on the upper side 71 of the mount part in a buried-in manner to form the same level with the upper surface of the rubber body 77*a*. The mount part 7*a* is formed so that the holding part at the end 7*e* will be positioned to have the lower surface of the trousers over it, however, desirably, the end part 7*w* will also be positioned to have the lower surface of the trousers over it. The length 1 of the mount part 7*a* is made an appropriate length for the width of the trousers mounted on the mount part 7*a*, i.e. for infant use, a shorter mount part is attached, and for adults, a longer mount part is attached.

The trousers are folded into two, at right angles to their longitudinal direction, and the folded part is mounted on the part 7*a*, and the length 1 is calculated as a result of having produced a standard width or size of folded trousers to be mounted, which varies from the minimum to the maximum widths of the trousers at the middle point of trouser length. For instance, the trousers to be mounted on the mount part 7*a* will be placed so that the middle point between both ends of the width at the above-mentioned folded part is identical with the perpendicular surface along the axial center line and that the middle point coincides with the center 7*y*, which is the middle point between the holding part 1*w* and 77*e*. At this time, if the fringe part of trousers does not overlap the holding part 1*w* or the holding part 77*e*; upon inclination of the hanger, the holding effects of the holding part 1*w* or 77*e* will not occur and the trousers will slide off.

Figure 12:
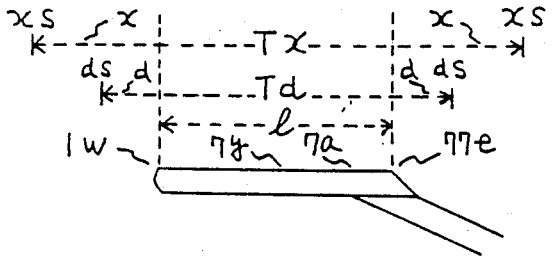
FIG. 12 is a side view of the trouser mount portion.

Therefore, as shown in FIG. 12, the width d from the holding part 1*w* of the mount part 7*a* or from the holding part 77*e* to the ends d s of the folded trousers is made an appropriate width in order to have effective holding action on the mounted trousers. It is desirable that larger sized trousers than the trousers Td be mounted thereon. In case that the maximum sized trousers Tx are the basis for calculating, for instance, the length 1 will be the length which is the balance between the fringes x s at both ends of the maximum sized trousers Tx and an appropriate width x. Therefore, the length of the mount part 7*a* is calculated by the formula $1=Tx-2x$, and the size range of trousers to be mounted on the mount part 7*a* of a certain length 1 shall desirably be the sizes ranging from the maximum sized trousers Tx with an appropriate overlap width x to the minimum sized trousers Td with an appropriate overlap d.

Figure 13:
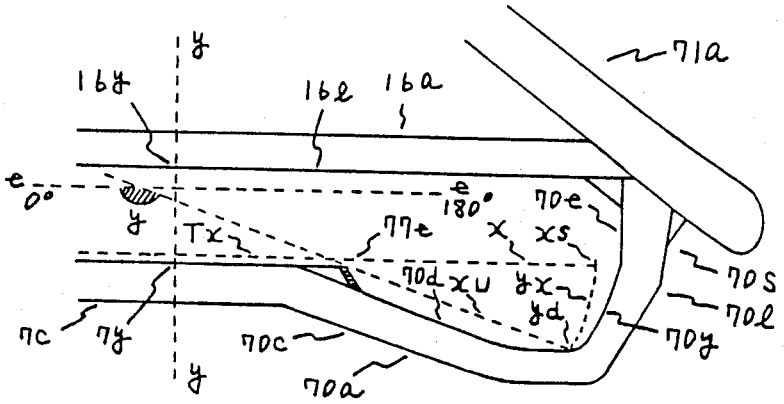
FIG. 13 is a side view of the recess area of a garment hanger according to the present invention.
Figure 14:
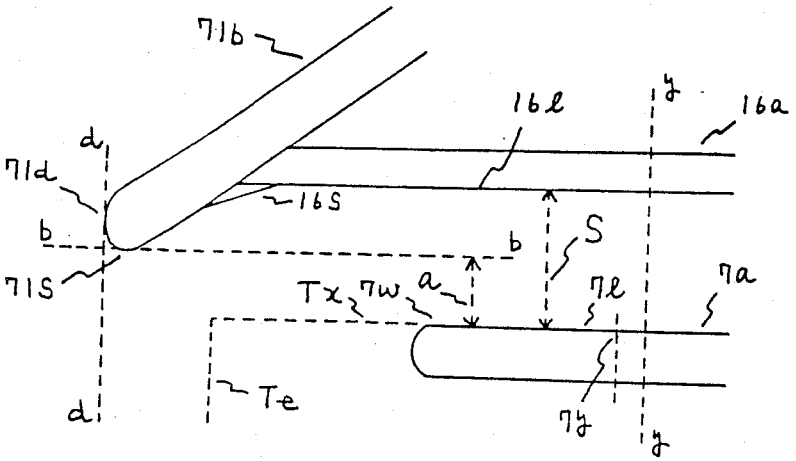
FIG. 14 is a side view of the open end area of a garment hanger according to the present invention.
Figure 15:
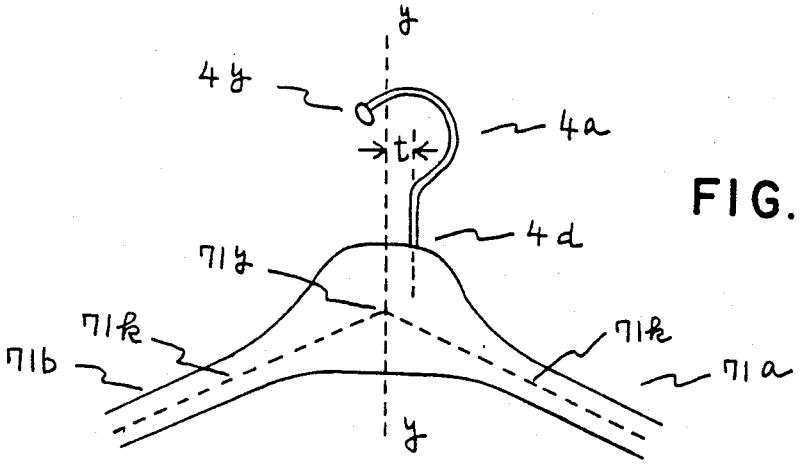
FIG. 15 is a side view of the hook area of a garment hanger according to the present invention.
Figure 16:
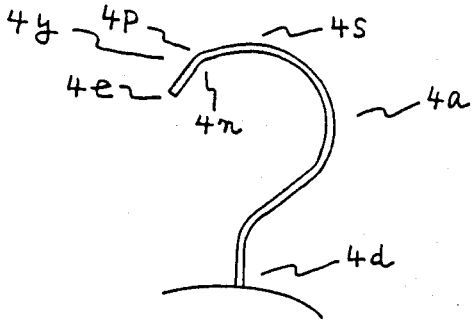
FIG. 16 is a side view of a hook.

For instance, for the standardized maximum sized trousers ranging from small sized to jumbo sized trousers, the width x for the width Tx parallel to the axial center line on the upper surface at the folded part of the trousers shall desirably be 53 mm-94 mm, and more desirably 59 mm-86 mm. The length 1 of the trousers mount part of the hanger in regard of this invention can be 41 mm-260 mm desirably 71 mm-16 mm and more desirably 76 mm-146 mm. When a larger value is used for x for the maximum sized trousers Tx of a certain standardized size, the length 1 will become shorter and the mounting size range will become broader. Conversely, when a smaller value is used for x, the length 1 will become longer and the mounting size range will become narrower. As shown in FIG. 13, to locate the mount part 7*a* on the hanger, horizontally, the center point 7*y* is included in the perpendicular center line y—y of the hanger, which in turn includes intersection point 71*y* of each axial center line 71*k* of the coat mount parts 71*a* and 71*b* (as shown in FIG. 15); and is positioned such that the vertical center surface containing line y—y intersects at right angle with the horizontal center line of the hanger spanning the coat mount parts at both sides, and is vertically positioned within an appropriate distance "a" based on a horizontal plane b—b coinciding with the bottom surface 71*s* of the coat mount part 71*b* (as shown in FIG. 14).

For instance, the distance from the center point 7*y*, or the upper surface of the mount part, to the horizontal surface b—b is desirably 37 mm and 6 mm, respectively, and more desirably 31 mm and 6 mm, respectively. When the center point 7*y* is positioned to coincide with the vertical center surface y—y, the effect is that the trousers mounted on the mount part 7*a* will settle between 71*a* and 71*b* of the coat mount part or at the horizontal middle position of the hanger. When the center point 7*y* is positioned higher vertically, the vertical height or width of the hanger becomes narrower, which leads to effects of the hanger becoming somewhat sturdier, and when the same is positioned lower, the effects will be easier mounting and dismounting of the trousers. By inclination of the hanger toward the open end, the recess part S serves to have the mounted trousers on the mount part *7a* held by the holding action of the end *7e*, and is shaped so as to not disturb the held condition of the trousers. As shown in FIG. 13, the recess is shaped with an appropriate breadth and depth based on a fan shape or a circular arc shape yx having a radius from the holding part *77e* to a certain point x s in a direction parallel to the axial center line and a center at the holding part *77e*, and extending to bottom point yd.

For instance, it is shaped based on the maximum sized trousers Tx within the mountable size range, that is, at the condition that the maximum sized trousers are mounted on the designated mount part *7a*, a circular arc shape yx either having a radius x from the upper fringe of trousers xs to holding part *77e* and having a center at the holding part *77e*, or a circular arc shape yx and extending to the bottom point yd. An outer surface 70*y*, downward of the trousers' upper fringes xs is shaped smoothly and slightly broader than the arc shape yx in order not to hamper the effectiveness of the holding part *77e* and, desirably, not to touch the trousers from the holding part *77e* to the upper trousers' fringe x s.

The bottom point yd is formed at an appropriate angle and position. For instance, a line xu leading from the holding part *77e* to the bottom point yd, or an angle y formed by the intersection of extension of line xu and a line to e—e parallel to the axial center line is of a range of 60°–174°, however, the range is desirably 125°–171° and more desirably 136°–164°.

It is desirable that the distance from the holding part *77e* to the bottom point yd be a length x. When, at inclination of the hanger for mounting clothes, the trouser's surface from the holding part *77e* to the trousers' fringe xs is supported by the bottom part of the recess S or upper surface 70*d* of the connecting part, the holding effects of the part *77e* diminishes and the trousers will slide and fall off. At the condition that the trousers are held at the position *77e*, the trousers' surface from the holding part *77e* to the trousers' fringe xs is positioned slightly upward of an horizontal line which agrees with the holding part *77e*, due to the trousers' weight balance effects. Therefore, the angle obtained by deducting an angle y from 180°, plus or minus a small amount, shall be the allowable possible angle of inclination at the time of mounting clothes. Therefore, the shallower the recess S is formed, with a larger value of the angle y to a line xu, the smaller the allowable possible angle of inclination will be; and when the recess S is made shallower with excessive larger value of the angle y, it poses a defect where the trousers will slide and fall off. As it is only required that the holding part formed exerts the holding effects for the trousers, the recess S is not necessarily formed with a bent connecting part, but also could be, of course, a recess of near square shape, for instance, comparatively shallow at the side of the connecting part 70*s*.

In the case of a clothes hanger for trousers only, and without coat mount part, the recess S can be made shallower as there is no need for coat mounting manipulation of the hanger and therefore less chance of the hanger to be inclined. The clothes hanger according to this invention has an appropriate angle y, which leads to no possible angle of inclination becoming smaller and as a result, of the trousers sliding and falling off. The connecting part 70*a* is strongly made to connect from the end of 71*a* to the recess S side of the end *7e* of the mount part *7a*, desirably to a lower part of the mount *7a*, and is formed so as to not hamper the effects of the holding part of the end *7e* and the recess S. At the side of the connecting part 70*s*, it is strongly connected desirably from lower part or inside surface of the coat mount part 71*a* to lower surface 16*e* of the connecting rod 16*a*. On the connecting part 70*a*, the mount part is made, for instance, with the aid of ribs, so as to be resistant against bending and twisting in all directions and so as not to weaken in use, and further so as to not dislocate from the predetermined position.

The upper surface 70*d* extending from lower side of the holding part *77e* to the bottom point yd is formed desirably near straight, which otherwise can be formed slightly bent inward or curved with a broader bottom of the recess S, or may form a horizontal bottom surface from the bottom point yd to the direction of the upper surface 70*d*. The upper surface 70*d* of the connecting part 70*a* can be equipped with a rubber body or with groovings. The outer surface 70*c* extending from lower surface *7c* of the mount part *7a* to the lower part of the recess S is desirably formed near straight, or slightly curved so as to not hamper clothes mounting and dismounting not to hamper the action of the holding part.

Next, in order to have the clothes hanger weight balanced, a hanging hook 4*a* is provided at position 4*d*. The position 4*d* of hanging hook 4*d* is determined so that the horizontal center line of the clothes hanger agrees desirably with a horizontal line, under conditions for instance that the standardized trousers are mounted on the designated mount position, where the standardized trousers for determination of the hanging balance position are the average of weights and sizes from the minimum- to the maximum-sized trousers in the mountable size range. Determination of the hanging position can either be mathematically calculated by weight of the hanger, or for instance be measured by actually hanging the hanger from a hanging fixture with the standardized trousers duly mounted at the designated mounting position. When the center point 7*y* is positioned in the vertical center surface y—y, the position 4*d* of the hanging hook 4*a* should necessarily be distant from the vertical center surface y—y. Therefore, in the case of a hanging hook 4*a* of the rotating type, the edge 4*y* of the hanging hook 4*a* is never positioned over the coat mount part 71*a*, and when the distance from the vertical center surface y—y is not great, it is rather desirable that the position be determined so as to not hamper mounting and dismounting coats. In the case of the hanger of this invention, the hanging metal hook 4*a*, when positioned in a fixed manner at a distant point from the vertical center surface y—y, rarely is positioned over the coat mount part 71*b*, unlike the edge part of the hanging metal hooks attached to the usual clothes hangers, and therefore, has the merit that the coat is never caught on the end 4*y* at the time of mounting and dismounting coats. If the coat mount part and the mount part *7a* are not loaded with the clothes, the imbalance of weights will cause the hanger to hang in the inclined position, and therefore, it is desirable, for instance, that when the hanger used for hanging inside moving vehicles, the hanging position is controlled so as to not fall off the hanger, due to shaking movements.

For instance, at the end 4*y* (see FIG. 16), a curved part 4*p* is formed, which can form a more curved recess 4*n* against a line linking the upper part 4*s* and the end part 4*e*. In other cases, a protrusion may be formed inward at the edge of a normal hanging metal hook, i.e.

a protrusion of rubber or plastic, etc. The connecting rod 16*a* is desirably provided so that the clothes hanger itself or the coat mount part will not be fragile. Mainly, the connecting rod is utilized to prevent the coat mount part from being twisted, bent or detached. For instance, the connecting rod 16*a* (as shown in FIG. 1) is fitted from the lower part of the coat mount part 71*a* to the lower part of 71*b*, and when the connection of the coat mount part with the connecting rod 16*a* is moved downward, the connection may be made wider (as shown in FIG. 13), so as to have a sturdier connection 70*s* with the connecting part 70*a*. The connection 70*s* should desirably be made durable using ribs to support the weight of trousers, without being bent. The distance from lower surface 16*l* of the connecting rod to upper surface 71 of the mount part is spaced appropriately not to hamper (as shown in FIG. 14) the smooth mounting and dismounting of clothes. The distance s between lower surface of the connecting rod and upper surface of the mount part can be 7 mm–140 mm, however, desirably it is 11 mm–57 mm and more desirably 19–46 mm.

In case the mount part 7*a* or the center point 7*y* is positioned higher or nearer to the horizontal surface b—b, the distance s to the connecting rod will desirably not be made larger so as to keep the strength of the coat mount part. When rubber or EVA is to be attached on upper surface 71 of the mount part, the distance s between the mount part 7*a* and the connection rod 16*a* should not be narrowed thereby. The trousers are desirably mounted on the designated position of the mount part 7*a*, however, as the position of the center point 7*y* will be hidden and obscured when the mount part 7*a* can be attached at a position 16*y* on the connecting rod, for the easier reference. By this way, the mounting at the designated position is made easier and the inclination of the hanger due to the trousers' weight imbalance is decreased. When the connecting rod is fitted above the lower fringe 71*s* of the coat mount part, the trousers will not be prevented from being caught on lower part of the coat mount part 71*b* at the time of the mounting and dismounting, which leads to providing a linear outer surface 16*s* from the lower surface 16*l* to lower fringe 71*s* of the part 71*b*. The quality of the plastic material used for the clothes hangers is desirably of a quality exhibiting less twisting or bending. When the trousers are mounted on the mount part of this hanger according to this invention, the trousers are folded in two at the middle of the trousers' length, inserted from the open-end side, and the folded part of the trousers is mounted on upper surface 71 of the mount part. In case the hanger is inclined toward the open-end side, all the weight of the mounted trousers is put on the holding part 77*e* of the end 7*e* and the trousers are held by this holding part 77*e*. That is, the surface of the trousers from the holding part 77*e* to the recess S side is afloat inside the recess S, by inclination of the hanger, all the weight of the trousers will be put on the holding part 77*e*. By this reason, the mounted trousers never fall off even though the clothes hanger is inclined. Conversely, when the hanger is inclined toward the recess S side, all the weight of the trousers will be put on the holding part 1*w* of the end 7*w*, and this holding part 1*w* holds the trousers.

Dismounting the mounted trousers is performed by pulling the trousers out from the open-end. The location of the trousers mount part 7*a* of the clothes hanger with coat mount part according to this invention, in a condition that the vertical center line of the hanger is perpendicular, can be made horizontal and parallel to a surface, $y^7$—$y^7$ (see FIG. 17), perpendicular and parallel to $y^7$—$y^7$ or at right angles with $y^7$—$y^7$ if the perpendicular surface containing each axial center line 71*k* of the coat mount part or the curved surface $y^7$—$y^7$ of the perpendicular direction is taken as a basis.

At a position horizontal and parallel to the surface $y^7$—$y^7$, as shown in FIG. 13, the center point 7*y* is positioned in the perpendicular center surface y—y when the perpendicular center surface y—y is taken as the base, as aforesaid. As shown in FIG. 14, when the center point 7*y* is positioned at a place distant from the position of the perpendicular center surface y—y toward the open-end side, as the center point 7*y* locates more distant from the perpendicular center surface y—y, the location 4*d* of hanging metal hook 4*a* or the position of the hanging fulcrum can be moved to be placed at the perpendicular center surface y—y, or at a place near thereto, or at another place positioned closer to the open-end side from the perpendicular center surface y—y. As the center point 7*y* is positioned more distant from the perpendicular center surface y—y, the mounting position of the trousers moves inevitably to the side of the open end, in which case the fringe Te of the maximum sized trousers Tx will be positioned near to the inner surface of the coat or to a perpendicular surface d—d coinciding with lower and outer surface 71*d* of the coat mount part 71*b*, or protrude therebeyond.

Therefore, the forming position of the mount part 7*a* should desirably be taken so that the fringe Te of the trousers being mounted on the mount part 7*a* will not be folded by touching the inner surface of a coat or protrude, and will be positioned suitably distant from the inner surface of the coat or the perpendicular surface d—d. When the mount part 7*a* is positioned distant from the perpendicular center surface y—y, the merit is that a broader space becomes available to form the connecting part 70*s*, however, this leads to the mounting part for the trousers being pushed to the open-end side in the total positional relationship of the hanger. Therefore, this case, as compared with the other where the center point 7*y* is positioned in the perpendicular center surface y—y, has merit and demerit at the same time. It is possible that the lower side of the coat mount part 71*b* can occupy a position lower than the lower part of the coat mount part 71*a*. For the sake of weight balance of the clothes hanger, the lower part of the coat mount 71*b* could be made of heavier material, for instance. when the center point 7*y* is positioned at a place distant from the perpendicular center surface y—y to the side of recess S, ty the effect of gravity, the inclination of the hanger, in the state where the hanger is not carrying clothes, becomes less; however, the defect is that the position 4*d* of the hanging metal hook 4*a* will be more distant from the perpendicular center surface y—y and then mounted trousers will be pushed to the side of recess S.

At a position vertical and parallel to the surface $y^7$—$y^7$, taking a plane b—b coinciding with lower fringe 71*s* of the coat mount part 71*b* as a base, the situation where the center point 7*y* is positioned above or below the plane b—b is as per the aforesaid explanation.

Figure 17:
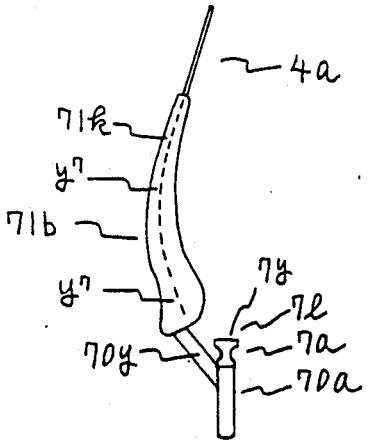
FIG. 17 is a rear view of a garment hanger according to the present invention.

It is possible that the lower part of the coat mount 71*b* will occupy a position higher than coat mount part 71*a*. At a position at right angle to the surface $y^7$—$y^7$, that is, to the direction of the other side or to this side, as indicated in FIG. 17 taking the surface $y^7$—$y^7$ as a base, the mounting and dismounting clothes will become somewhat easier if the center point 7y is positioned at a place distant from the surface y—y, however, the mounted trousers on the part 7a protrude and rub against the inner surface of the coat, or both ends of the mount part 7a protrude. Therefore, this part should desirably be formed so as to not protrude and catch on the clothes.

In case the center point 7y is positioned distant from the surface $y^7$—$y^7$, in the state of the hanger having trousers mounted thereon, a part extending at least from the joint of the connecting part 70a with the mount part 7a to the lower part of the connection 70s should be provided so that this part will not be engaged from the perpendicular. In this way, hampering of the holding effect of holding part 77e by connecting part 70a would be prevented.

Figure 31:
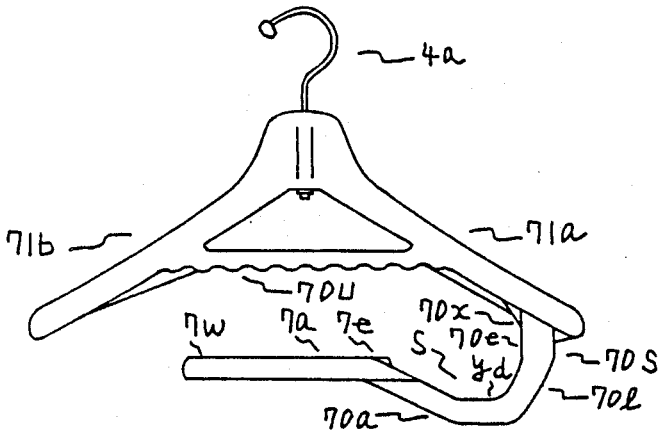
FIGS. 31, 32, 34 and 39 are side views of various garment hangers according to the present invention.

For instance, holes can be provided in the possible range of the combinative part with the mount part 7a or the connecting part 70s, or further, those holes can be provided in several parallel lines on an area from the mount 7a to the connection 70s in the combinative part. At the bottom of recess S, a deeper and broader plane can be formed for instance, where some rubber or sponge bodies can be attached and neckties, etc. can be mounted thereon. Next, when a connecting rod is not equipped to a base composed of the coat mount part, or in the case of a clothes hanger where the connecting rod is positioned higher, an outer surface 70x is formed upward of the outer surface 70e of the connecting part 70a as shown in FIG. 31, which connects to the inner surface of the coat mount part 71a. The combinative part with the inner surface should preferably be shaped linear or curved from a position near to the inner surface to upward along the inner surface and connect thereto. To assure a durable joint, the combinative part can be made wider or broader.

To have the coat mount part made durable, it is of course possible that the coat mount part 71a and 71b be made wider than normal or the lower surface 70u of the coat mount part is reinforced in wave shape.

In the case where the clothes hanger is not equipped with a connecting rod, the mount part 7a should preferably not be positioned distantly downward from the plane b—b. The shape of the end 7e or 7w of the mount part 7a will not necessarily be same with the aforesaid shape, but also can be made acute angular, obtuse angular, arced, polygonal, or with one or more of protrusions, projections, angles, edge parts, polygons, boundaries or outer surfaces.

Figure 18:
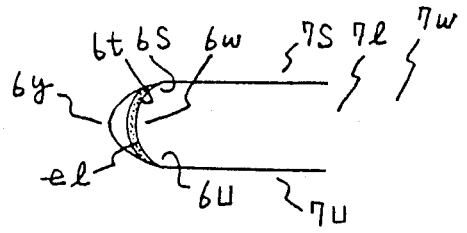
FIG. 18 is a plan view of the open end portion of a trouser mount portion.

At the end 7w, as indicated in FIG. 18, for instance, an edge part of arc shape 6t is formed at the end of the upper surface 71, and the holding part 6w is formed at the border between the upper surface 71 and the outer surface of the open end side. On both side surfaces of the edge part 6t, the holding parts 6s and 6u are respectively formed. As it becomes more distant from the edge part 6t obliquely downward, an arc shaped protrusion 6y composed of a protruded smooth arc surface is formed. A smooth arc surface is formed from the holding part 6w to the arc shaped protrusion 6y . Also the outer surfaces from the arc shaped protrusion 6y to both sides 7s and 7u, as well as to the lower surface 7c are as a smoothly arc surface.

On an outer surface adjacent to the edge part 6t, the micro-groovings el are provided. The protrusion 6y, as compared to the protrusion 1y of FIGS. 2 to 5, is formed wider, horizontal and at right angles to the axial center line, or with a smoother circular arc or spherical surface of greater thickness. At the time of inclination of the hanger with mounted trousers thereon, the holding parts 6s and 6u act to prevent sliding. The shape of the edge part of the surface 71 can be made of half circular or elliptical arc shape. On the outer surface of the protrusion 6y, another projection, such as a projection of half spherical shape can be formed.

Figure 19:
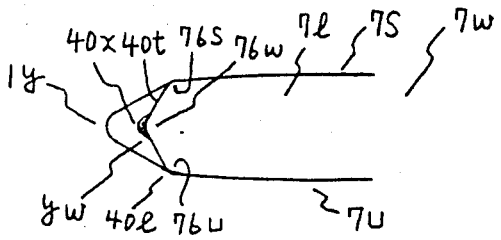
FIG. 19 is a plan view of the open end portion of another trouser mount portion.

As shown in FIG. 19, the holding part formed at the edge part of the upper surface 71 is shaped more sharply compared to the holding part 1w in FIGS. 2 to 5. That is, the angular part of the edge part of the upper surface 71 is formed milder for an area from a side 7u to the other 7s, and shaped to take a part of a near rounded-off hexagon.

A straight and smooth shaped surface 40x is formed from the angle part at the end part of the upper surface 71 downward obliquely to the arc shaped protrusion 1y . At the nearly rounded-off, polyhedral, smooth, angular part at the boundary between the shaped surface 40x and the angular part of the upper surface 71, an angular holding part 76w is formed. Also, angular holding parts 76s and 76u are formed respectively on both sides of the upper surface 71.

From the angular holding part 76w to the holding part 76s and 76u, a straight edge 74t is formed. Also side surfaces 40l of the holding parts 76s and 76u are formed smoothly. The outer surface y w extends from the arc shaped protrusion 1y and the shaped surface 40x to upper surface straight parts 40t and both sides are formed planely. The shaped surface 40x is formed, for instance, in the range of angles d1.

Figure 20:
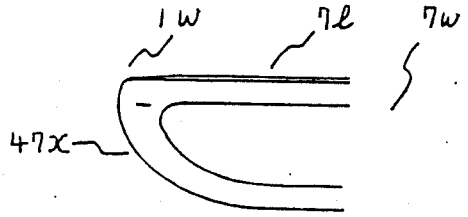
FIG. 20 is a side view of the open end portion of a trouser mount portion.

As shown in FIG. 20, the edge part of the upper surface 71 may be formed, for instance, as half elliptical or half circular. Without the protrusion 1y being formed, the angle made between the outer surface 47x on the side of the open-end and the upper surface 71 can be formed to be an acute angle within the range of the desirable angles of d1. Also, for instance, a projection of half spherical shape can be provided on outer surface of the holding part 1w.

Figure 21:
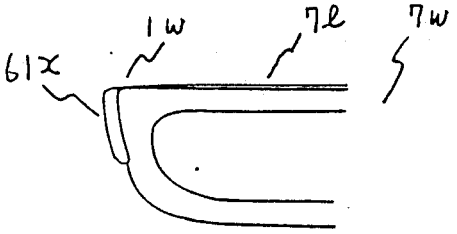
FIG. 21 is a side view of another open end portion of a trouser mount portion.
Figure 22:
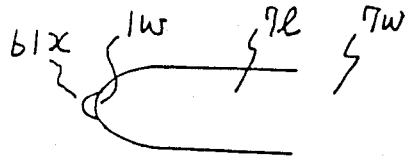
FIG. 22 is a plan view of the open end portion of FIG. 21.
Figure 23:
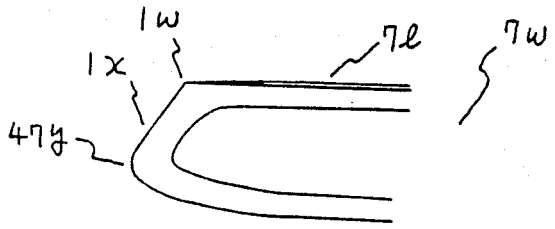
FIG. 23 is a side view of another open end portion of a trouser mount.

FIGS. 21 and 22 show an example where a shaped projection is provided downwardly on the outer surface to form the holding part 1w of the upper surface 71. This projection is indicated as the long, shaped projection 61x with the shape of a long spherical cut in two in longitudinal direction The long shaped projection part 61x achieves the anti-skid effects by the projective actions on the trousers surface at the inclination toward the recess S side. The long projection part can be made of other shapes such as arc surface or polyhedral cylindrical. The protrusion 1y can also be equipped, for instance, as the protrusion 47y shown in FIG. 23, at a position more distant from the upper surface 71 or at a position near to a plane coinciding with the lower surface 7c.

Figure 24:
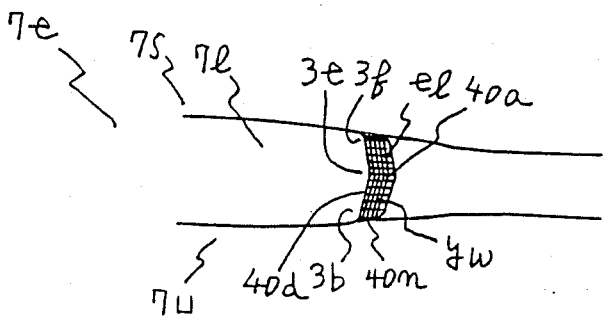
FIG. 24 is a plan view of the recess side end portion of a trouser mount.

At the end 7e, as indicated in FIG. 24, an angular holding part 3e of the shape of an angular part of a near rounded-off polyhedron is formed at boundary between the outer surface at the side of recess S and the edge part at the recess S side of the upper surface 71. The edge part of the upper surface 71 is formed as a part of a near rounded-off hexagon shape including the angular holding part 3e for an area from side 7u to the other side 7s, and the angular holding parts 3b and 3f are respectively formed on both sides of the upper surface 71. From the angular holding part 3e, the straight edge parts 40*d* are formed respectively to 3*b* and 3*f*. From the angular holding parts 3*e*, 3*b* and 3*f*, the straight edge shaped surfaces 40*a* and 40*n* are formed obliquely downward, respectively. The outer surface y w is formed planely from the straight edge shaped surfaces 40*a* to 40*n*, respectively.

Figure 25:
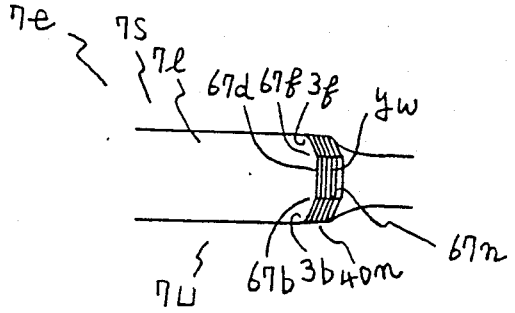
FIG. 25 is a plan view of another recess side end portion of a trouser mount.
Figure 26:
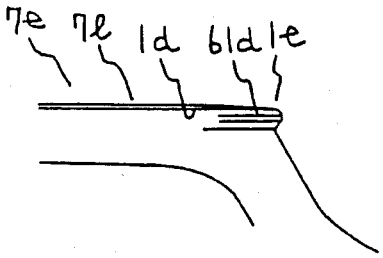
FIGS. 26–28 are side views of the recess side end portions of various trouser mounts.

The straight edge shaped surface 40*a* or the straight edge parts 40*d* are formed for an angle within the angles range of d4. The angular holding part is shaped suitably smooth. Micro-groovings are equipped on the outer surface yw near to the upper surface 71 or on both sides thereof. FIG. 25 indicates an example where there is no angular holding part 3*e* as aforesaid, but the position where this angular holding part would have been was cut off to form a plane surface y w, which was shaped nearly trapezoidally. The edge part of the upper surface 71 is formed as near rounded-off octagon, and the angular holding parts 67*b* and 67*f* are repsectively formed at places near to sides 7*s* and 7*u* of the upper surface 71, and a straight edge part 67*d* is formed between angular holding parts 67*b* and 67*f* at the recess S side of the upper surface 71. The straight edge shaped surfaces 67*n* are respectively formed downwardly from the angular holding parts 67*b* and 67*f*. An outer surface y w between the two straight edge shaped surfaces 67*n* as well as another outer surface extending from the straight edge shaped surfaces 67*n* to the surfaces 40*n* on both sides are planely formed. The outer surface y w is formed within angles of the range of d4. On the outer surface yw and on another extending to both sides, microgroovings el are provided. FIG. 26 shows an example where an elliptical, arc-shaped, long projection 61*d* is equipped on the edge part 1*d* of the upper surface 71.

The holding part 61*d* is formed at the boundary between the end part of the upper surface 71 and outer surface to the side of the recess S, beneath which the long-shaped projection 61*d* with the shape of a hexagon cut in two in longitudinal direction is formed in elliptical shape. The long-shaped projection 61*d* will exert holding effect for the mounted trousers when the hanger is inclined for mounting a coat. The shape of the long-shaped projection part can be formed, for instance, of polyhedral cylindrical or long-spherical shapes.

Figure 27:
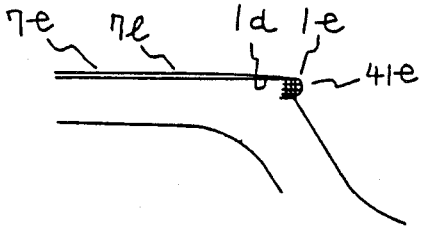
Figure 28:
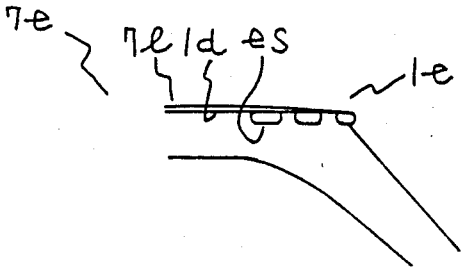
Figure 29:
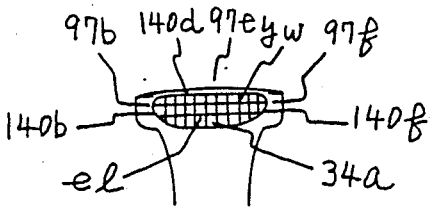
FIG. 29 is a front view of a recess side end portion of a trouser mount.
Figure 30:
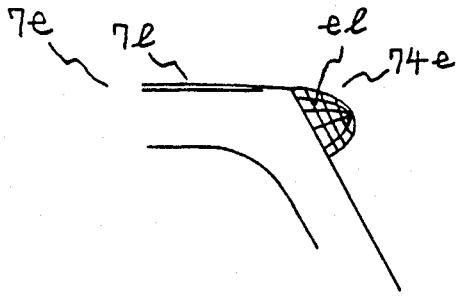
FIG. 30 is a side view of a further recess side end portion of a trouser mount.

The projection part 61*d* prevents the trousers from being caught by having the part made longer. As shown in FIG. 27, the projection part can be formed only at a position downward of the holding part 1*e*. For instance, the projection part 41*e* can be provided in a protruding shape or in varying levels. As shown in FIG. 28, on the outer surface to the recess S side, and at the position of the edge part 1*d*, a plurality of smaller projections of half long-spherical shape es are provided in parallel lines along the edge part 1*d*. As shown in FIG. 29, the holding part 97*e* of angular shape is formed at the end part to the recess S side of the upper surface 71, and the edge part of the upper surface 71 is formed as a near rounded-off hexagon including the holding part 97*e*. At both side surfaces, holding parts 97*b* and 97*f* of arc shape, each with an arc surface protruding sideways is formed. The edge shaped surface 34*a* extends obliquely downward from the holding part 97*e*. From the edge shaped surface 34*a*, a plane outer surface y w is formed to the arc shaped holding parts 97*b* and 97*f* at both sides. From the holding part 97*e* to the arc shaped holding parts 97*b* and 97*f*, straight edge parts 140*d* are formed respectively, and at the arc edge of the arc shaped holding part 97*b* and 97*f*, the edge parts 140*b* and 140*f* leading to the edge part 140*d* are respectively formed. On the outer surface of y w, micro-groovings el are provided. For instance, the edge shaped surface 34*a* or the edge part 140*d* can be formed within the angular range of d4. As shown in FIG. 30, on the outer surface to the recess S side of the upper surface's position, projection 74*e* of rubber material of half elliptical or half spherical shape can be provided. On the outer surface of the rubber projection 74*e*, micro-groovings el are provided, and the shape of the rubber projection 74*e* can be polyhedral. This should desirably be shaped so that the trousers are not caught on those projections at the time of dismounting.

Further, the edge part of upper surface 71 to the side of the end part 7*e* can be made of an acute angular shape formed by an acute angle to the upper surface 71 in the outline shape of the perpendicular cross section. At the outer surface of the end part 7*e* or 7*w*, the outline shape of the perpendicular cross section can be, for instance, of elliptical arc or circular arc shape.

Figure 32:
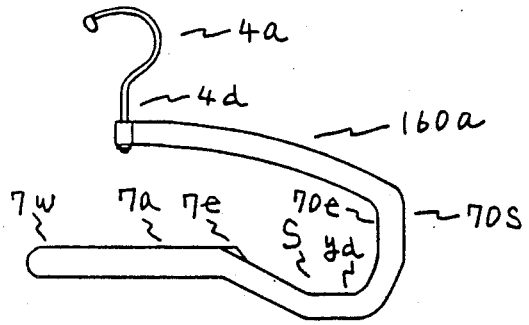

Next, explanation will be given of a practical example regarding the clothes hanger according to this invention, where the mount part for trousers is connected to the base and where no mount part for coat is equipped. Namely, as shown in FIG. 32, the mount part for trousers 7*a* is connected to the form body 160*a* with the hanging metal hook 4*a*, by way of the connection 70*s* of the connecting part 70*a*.

Figure 33:
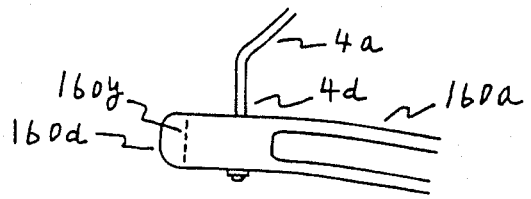
FIG. 33 is a side view of the hook area of a garment hanger.

In this case, as shown in FIG. 33, the upper part of the body 160*a* is made somewhat longer at the end and a marker 160*y* at an upper position on the perpendicular line for the center point 7*y* can be provided. Due to this marker 160*y*, the mounting on the designated mount position becomes easier and relieves the chance that the clothes hanger is inclined, due to trouser misplacement.

Next, explanation will be given of a practical example regarding the clothes hanger according to this invention, where the mount part for trousers is made of metal rod and is integrally connected to a base made of the metal rod.

Figure 34:
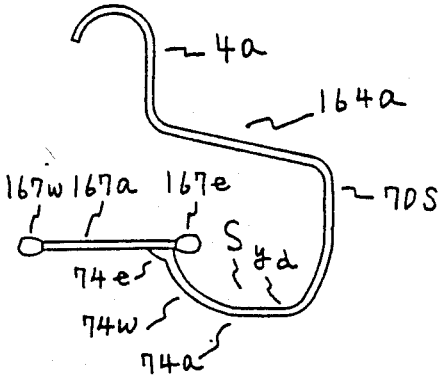
Figure 35:
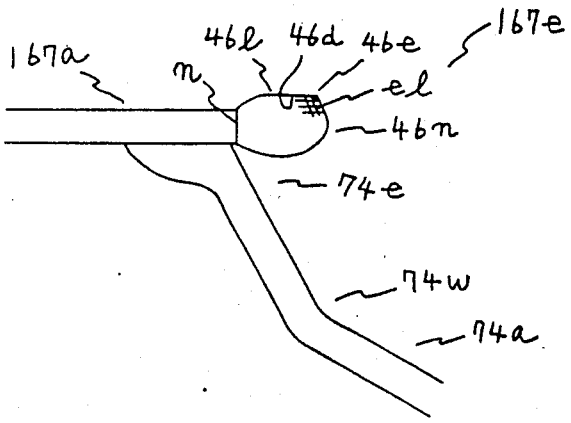
FIG. 35 is a side view of the recess side end portion of a trouser mount.
Figure 36:
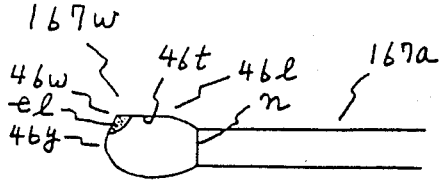
FIG. 36 is a side view of the open end end portion of a trouser mount.

Namely, as shown in FIGS. 34–36, end stickers 167*e* and 167*w* of rubber material and of near cylindrical shapes are attached to the end of the mount part 167*a*. For the end sticker 167*e*, the edge part 46*d* is of half circular shape, and at the arc part of the edge part 46*d*, the holding part 46*e* is formed, and at a place obliquely downward therefrom, a protrusion of an arc surface shape 46*n* is formed, of which the outer surface is shaped smoothly to the joint part n with the mount part 167*a*, and the joint part n is so formed as to not catch on trousers when mounting trousers.

Figure 37:
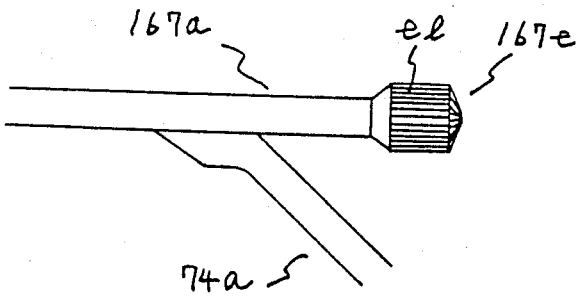
FIG. 37 is a side view of another recess side end portion of a trouser mount.

Also at the sticker 167*w*, the edge part 46*t*, the holding part 46*w*, and the protrusion of arc surface shape 46*y* are formed. To prevent the trousers from being pinched between the connecting part 74*a* and the end sticker 167*e*, and to have the angle of intersection of the connecting part 74*a* with the mount part 167*a* sufficiently large, a clearance is provided in the downward direction for the end sticker 167*e*. For instance, as indicated in FIGS. 34 or 35, a part of the connecting part 74*a* near the connection 74*e* with the mount part 167*a* is curved or bent to the outside direction of the recess S. The shape of the end sticker, as shown in FIG. 37, can either be made of cylindrical or polyhedral cylindrical form, or can be made of soft vinyl chloride material, or the mount part 167*a* can be covered with a synthetic substance.

Figure 38:
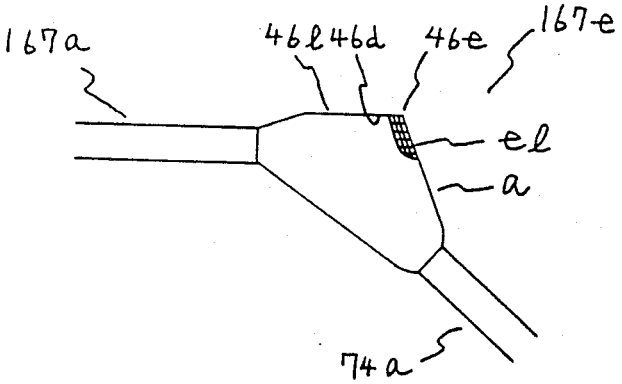
FIG. 38 is a side view of a further recess side end portion of a trouser mount.
Figure 39:
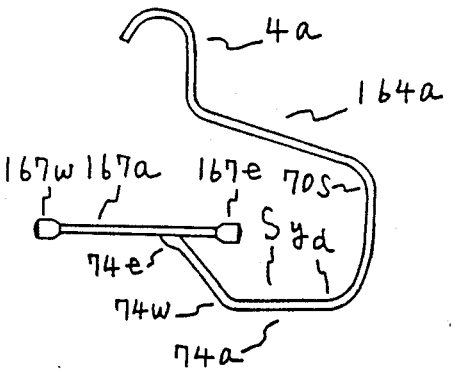

Additionally, the mount part 167*a* and the connecting part 74*a* are integrated to form a joint body and the part of the bent angle is made to be the end. For instance, as indicated in FIG. 38, the end sticker 167*e* can either be attached to the bent angle part, or micro-groovings el can be provided on the outer surface of the metal rod's bent angle part, without the end sticker being attached.

It is, of course, possible that the mount part for trousers made of the metal rod is connected and bound with the coat mount part made of plastic material, and further, for instance, that the mount part for trousers is made in the horizontal direction, with uneven levels, or with more than one level in a number of parallel lines. The end shape of the mount part for trousers can, of course, be made as a smooth arc, cut or planar forms for its outer surface, without, for instance, forming protrusions or edges at all. However, when the protrusion or edge part is not provided, the holding effects will be lessened, and mounting and dismounting of clothes will be disturbed if the end part is made in an acute angular shape. The micro-groovings provided on outer surface of the end part 7*e* or 7*w* can be made of linear projections, semi-spherical or polyhedral projections or a roughened surface, etc.

Trousers mounted on the mount part for trousers are prevented from falling off, when the clothes hanger is inclined to the side of the open-end, by the holding part on the side of the recess S, and the holding part or the part functioning for holding is preferably formed mainly at the end part or edge part on the upper surface 71 on the side of the recess S, or at the outer or side surfaces adjacent to the upper surface 71 on the side of the recess S. However, not to be limited to this, the aforesaid holdpart, projection or grooving can also, of course, be provided as one or several elements, in succession, in stairs or in scattered form, for instance on the outer surface to the side of the end 7*e* inside the recess S, or on the upper surface 70*d* of the connecting part. By having the holding part at the side of the recess S positioned to face the lower surface of the trousers, the trousers are prevented from sliding to the open-end side at the inclination of the clothes hanger. The holding part at the side of the open-end should preferably be formed beneath the lower surface of the trousers, and when the frictional material, etc. is used on the upper surface 71, the mount part 7*a* can of course be provided in a long shape to the side of the open-end. The materials for various parts of the clothes hanger according to this invention can be of wood, synthetic materials or aluminium; and the designs, ribs or shapes can be formed in straight or curved shapes.

The clothes hanger according to this invention does not require troublesome mounting and dismounting actions such as a pinching action for mounting, insertion through a loop for mounting, disengagement of other clothes for mounting and dismounting trousers on the mount part of the conventional loop-type clothes hangers; and offers extremely easy actions for mounting and dismounting. As the trousers mounted on the mount part are supported at one end or the other of the trousers mount part even though in a state of the clothes hanger being inclined at all degrees and to all directions, the trousers never slide in a direction parallel to the trousers mount part or at right angles to it, nor fall off.

Though the clothes hanger will be in a state of inclination at all possible angles or directions when the coat is mounted or dismounted when the trousers have been mounted on the trousers mount part, the clothes hanger can be inclined at will and the coat can be mounted or dismounted as the mounted trousers never slide or fall off. Therefore, this clothes hanger offers extremely easy mounting and dismounting of the coat as well, and excludes, unlike the conventional types of clothes hanger, the worrisome actions and needs required for the mounted trousers sliding to an end or falling off while the coat is being mounted or dismounted and such trousers being put into the original position on the mount part or picked up from the floor and mounted on the clothes hanger once again. Even in the case where trousers are to be mounted or dismounted on the trousers mount part in a state that the coat is mounted on the coat mount part, the actions for mounting and dismounting trousers are found easier as an end of the trousers mount part is formed distant, with a broader clearance in between, from the lower end of the coat mounting part. That is, no worrisome action is required, unlike the conventional clothes hangers, as having to dismount the mounted coat from the coat mounting part to mount trousers, and extremely easy mounting from trousers is provided with a state that the coat is mounted, intact. As there is no chance of the mounted trousers at the mount part sliding to an end, it should be rare that the clothes hanger will incline due to uneven weight effect of the trousers.

That the holding part at the end to the side of the recess of the trousers mounting part is formed beneath the lower surface of trousers and the length of the trousers mounting part is appropriate excludes the possibility of the mounted trousers being slid in a direction at right angles to the axial center line, or of falling off. Both fringes of the trousers mounted on the trousers mount part are in a state of floating without touching the trouser mount part, and will not be pressed on the upper surface of the trouser mounting part by the selfweight of the trousers. Therefore, there is no worry that multiple creases will occur or that the creases will extend at the folded part. Further, no need to mount or dismount by inserting through a loop excludes the chance of wrinkles caused at the time of mounting and dismounting. The outer surface of the trousers mount part is smooth without anti-skid material having contact friction, which excludes that the mounting and dismounting are hampered by the contact friction resistance effects, and ensures extremely easy mounting and dismounting.

No possibility of the trousers sliding and falling off excludes the change of the trousers falling on the floor and staining. When the hanging position is set in a fixed manner at a position distant from the perpendicular center surface of the clothes hanger, the case becomes less likely where the coat is damaged by an edge of the hanging metal hook. With the aforesaid various merits, the present invention provides a clothes hanger without the defects of the conventional clothes hangers.

What is claimed is:

1. A garment hanger comprising a hook means for engaging a supporting means; a trouser mounting means for supporting a pair of trousers, said trouser mounting means including a trouser mounting member adapted to support a pair of trousers folded thereover and having a first and a second end which are spaced apart by a predetermined distance; a connecting means for rigidly connecting said hook means and said trouser mounting means, said connecting means having first, second and third portions, said first portion connected to and extending downwardly from said trouser mounting member, said third portion connected to and extending downwardly from said hook member, said second portion connecting said first and third portions below said trouser mounting member and proximate said first end of said trouser mounting, said hook means and said connecting means cooperating to support said trouser mounting means centrally below said hook means, when said hook means engages said supporting means, with said trouser mounting member disposed horizontally, said first and second portions of said connecting means defining a recess below said horizontally disposed trouser mounting member, said recess centered on said first end of said trouser mounting member and having an upper part and a lowermost point; and first holding means for engaging and holding said trousers against slippage with respect to said trouser mounting member when said second end of said trouser mounting member is lowered with respect to said first end of said trouser mounting member, said first holding means disposed proximate said first end of said trouser mounting member so as to engage said trousers only when said second end of said trouser mounting member is lowered with respect to said first end of said trouser mounting member.

2. The garment hanger according to claim 1, wherein said third portion comprises a first shoulder portion and a second shoulder portion, said first shoulder portion extending between said second portion and said hook means, said first shoulder portion extending downwardly from said hook means, said second shoulder portion extending downwardly from said hook means and opposite said first shoulder portion, said first and second shoulder portions together defining a coat mounting means for supporting a coat.

3. The garment hanger according to claim 2, wherein a horizontal support rod connects said first shoulder portion and said second shoulder portion, and said trouser mounting member is parallel to and spaced apart from said horizontal support rod.

4. The garment hanger according to claim 3, wherein said support rod and said trouser mounting member are separated by a distance of 11–57 mm.

5. The garment hanger according to claim 4, wherein said distance is 19–46 mm.

6. The garment hanger according to claim 1, wherein the angle formed between said horizontal trouser mounting member and an imaginary line connecting said first end of said trouser mounting member and said lowermost point of said recess is 60°–74°.

7. The garment hanger according to claim 6, wherein said angle is 125°–171°.

8. The garment hanger according to claim 7, wherein said angle is 136°–64°.

9. The garment hanger according to claim 1, wherein said first and second ends of said trouser mounting member are separated by a distance of 41–260 mm.

10. The garment hanger according to claim 9, wherein said distance is 71–160 mm.

11. The garment hanger according to claim 10, wherein said distance is 76–146 mm.

12. The garment hanger according to claim 1, further comprising second holding means for engaging and holding said trousers against slippage with respect to said trouser mounting member when said first end of said trouser mounting member is lowered with respect to said second end of said trouser mounting member, said second holding means disposed proximate said second end of said trouser mounting member so as to engage said trousers only when said first end of said trouser mounting member is lowered with repesct to said second end of said trouser mounting member.

13. The garment hanger according to claim 12, wherein said second holding means comprises a grooved surface formed on said second end of said trouser mounting member.

14. The garment hanger according to claim 12, wherein said second holding means comprises a frictional surface formed on said second end of said trouser mounting member.

15. The garment hanger according to claim 14 wherein said frictional surface is an anti-skid material.

16. The garment hanger according to claim 15, wherein said anti-skid material is selected from the group consisting of rubber and sponge.

17. The garment hanger according to claim 1, wherein said first holding means comprises a grooved surface formed on said first end of said trouser mounting member.

18. The garment hanger according to claim 1, wherein said first holding means comprises a frictional surface formed on said first end of said trouser mounting member.

19. The garment hanger according to claim 18, wherein said frictional surface is an anti-skid material.

20. The garment hanger according to claim 19, wherein said anti-skid material is selected from the group consisting of rubber and sponge.

21. The garment hanger according to claim 1, wherein said predetermined distance between said first end and said second end of said trouser mounting member is less than the width of a pair of trousers folded thereover.

* * * * *